United States Patent [19]

Harris

[11] 4,167,894

[45] Sep. 18, 1979

[54] STEAM ENGINE IN WHICH THE CYLINDER INLET VALVES ARE ACTUATED BY THE OPERATION OF THE POWER CONVERSION MEANS

[76] Inventor: Marion K. Harris, P.O. Box 1591, Atascadero, Calif. 93422

[21] Appl. No.: 916,814

[22] Filed: Jun. 19, 1978

Related U.S. Application Data

[63] Continuation-in-part of Ser. No. 765,676, Feb. 4, 1977, Pat. No. 4,111,102.

[51] Int. Cl.[2] ..... F01B 3/10

[52] U.S. Cl. ..... 91/480

[58] Field of Search ..... 417/510; 123/58 BC, 123/58 AM; 91/480, 188

[56] References Cited

U.S. PATENT DOCUMENTS

| | | | |
|---|---|---|---|
| 1,613,116 | 3/1927 | Mitchell | 123/58 BC |
| 2,088,582 | 8/1937 | Bishop | 91/481 |
| 3,050,005 | 8/1962 | Pschunder | 91/480 |
| 3,105,415 | 10/1963 | De Muth | 91/188 |
| 3,572,215 | 6/1969 | Harris | 91/180 |
| 3,621,759 | 2/1970 | Cousino | 91/188 |

*Primary Examiner*—William L. Freeh
*Attorney, Agent, or Firm*—Jack M. Wiseman

[57] ABSTRACT

A steam engine with axially aligned cylinders. Disposed within the cylinders are aligned pistons. An inlet valve is provided for each cylinder to control the flow of steam in the associated cylinder for imparting a reciprocating movement to the piston in the associated cylinder. Power conversion means have a swash plate that is disposed between the pistons and that is rotated by the sequential power strokes of the pistons. The inlet valves are actuated by means responsive to the movement of the swash plate to control the flow of steam in the cylinders. The swash plate is formed with recessed, annular thrust surfaces. Projecting at right angles from the recessed, thrust surfaces are ribbon cams, which engage push rods for actuating the same. The push rods actuate the inlet valves. The throat thickness of the swash plate between the recessed, annular thrust surfaces is of a uniform dimension along the circumferential paths thereof. The recessed, annular thrust surfaces have their axes coincident with the axis of rotation of the swash plate so that the radial components thereof are at right angles to the axis of rotation of the swash plate.

12 Claims, 4 Drawing Figures

Fig-1
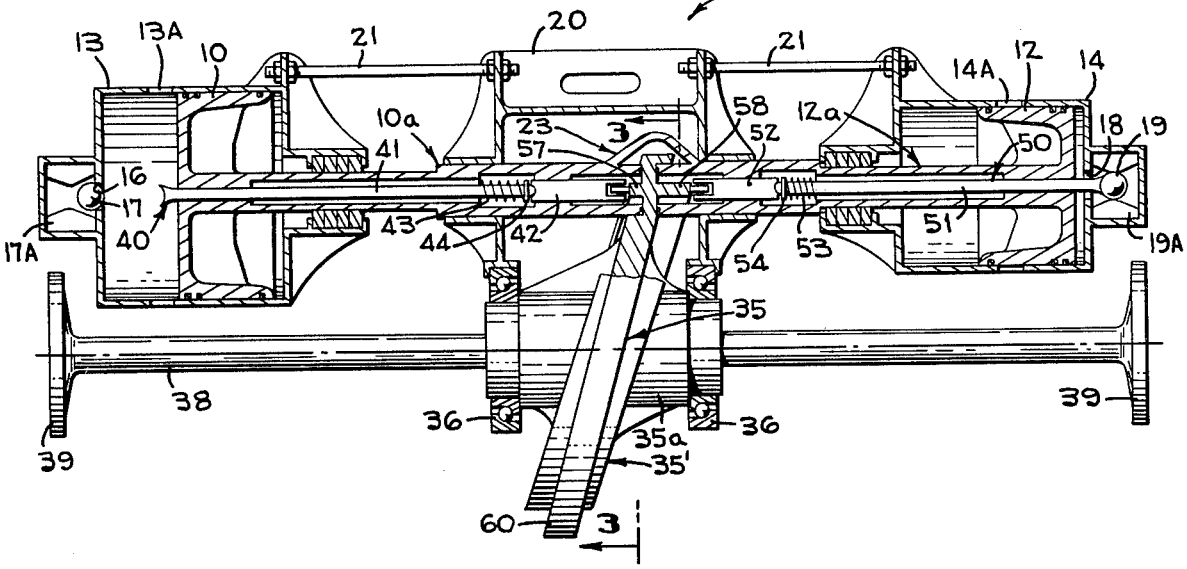
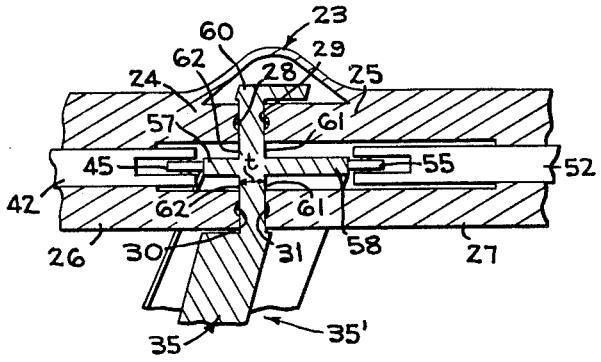
Fig-2
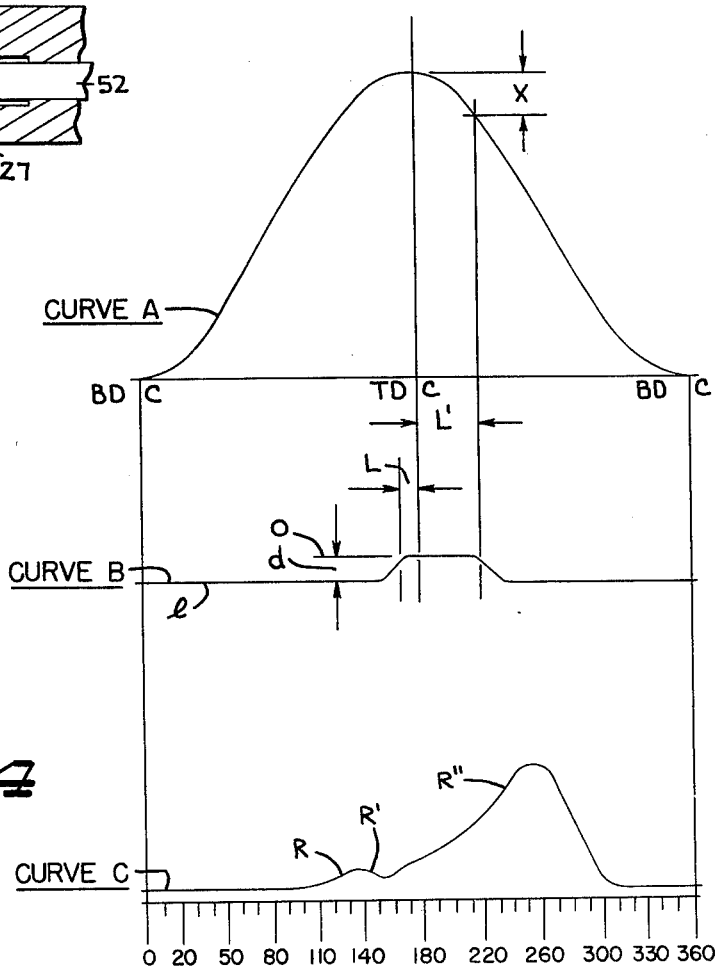
Fig-4

STEAM ENGINE IN WHICH THE CYLINDER INLET VALVES ARE ACTUATED BY THE OPERATION OF THE POWER CONVERSION MEANS

RELATED CASE

This application is a continuation-in-part of my copending application, Ser. No. 765,676, filed on Feb. 4, 1977, now U.S. Pat. No. 4,111,102, for Steam Engine In Which The Cylinder Inlet Valves Are Actuated By The Operation Of The Power Conversion Means.

BACKGROUND OF THE INVENTION

The present invention relates in general to steam engines, and more particularly to an arrangement for controlling the actuation of the inlet valves for the cylinders of a steam engine.

In the U.S. patent to Marion K. Harris, No. 3,572,215, issued on Mar. 23, 1971, for Single Acting Steam Engine, there is disclosed a steam engine in which the inlet valves for the cylinders are opened by the movement of a separate cam located on the output shaft of the engine. Such valve-actuating arrangements were particularly adapted to the mushroom poppet valve. The mushroom poppet valves in steam engines do not lend themselves to be located in the cylinder head to reduce steam inlet passage length to a minimum for facilitating filling of the cylinders with live steam.

Impulse valves have been disposed in the cylinder head. However, such impulse valves have been actuated by attaching a fixed, rigid stud to the top of the piston. This arrangement is limited in that only a valve event symmetrical with the top dead center can be achieved. Thus, either the valve opening lead before top dead center must be too long for good low running speed or the cutoff after top dead center must be very short, thereby limiting specific output.

SUMMARY OF THE INVENTION

A steam engine in which an inlet valve controls the flow of steam in a cylinder. A piston disposed in the cylinder is reciprocated by the flow of steam in the cylinder. Power conversion means are operatively responsive to the reciprocation of the piston for converting the rectilinear movement of the piston into a rotary motion. Valve-actuating means are operatively responsive to the movement of the power conversion means for controlling the opening and closing of the inlet valve.

In the exemplary embodiment of the present invention, the valve-actuating means includes a swash plate. The swash plate is rotated by the power strokes of the piston. A ribbon cam on the swash plate is in engagement with a cam follower. The movement of the cam follower riding on the ribbon cam of the swash plate actuates a push rod which is slidably journalled for movement parallel to the path of travel of the piston. Through the action, the push rod moves with the piston during part of its stroke and moves relative to the piston under the control of the swash plate, ribbon cam and cam follower to actuate and open the inlet valve.

A feature of the present invention is that the contour of the ribbon cam effects the opening of the inlet valve on a short lead before the piston reaches its top dead center and allows the inlet valve to cut off the flow of steam into the cylinder at a relatively long interval after the piston has reached its top dead center.

It is an object of the present invention to provide valve-actuating means which are effective to obtain a desired inlet valve opening and closing event for the flow of steam into a cylinder, which event is asymmetrical relative to the top dead center position of the piston disposed in the cylinder.

It is another object of the present invention to provide valve-actuating means capable of opening an inlet valve for controlling the flow of steam into a cylinder of a steam engine at a low acceleration in order to minimize shock loading and inertia forces in the valve and valve train.

A feature of the present invention is that a short connecting inlet passage minimizes the top dead center volume, thereby improving volumetric efficiency of the engine.

The present invention employs a cam-driven push rod for actuating an impulse valve to provide an assymetric intake valve event with a short lead and a relatively longer cutoff. In addition, the length of the lead and the cutoff are independent of one another to adapt the engine to various applications and to control the rate of initial opening and final closing of the impulse valve without regard to piston velocities prevailing at the time these events occur. Hence, shock loading on the valve and valve seat is reduced and the inertial forces in the valve-actuating mechanism are reduced.

According to the present invention, the swash plate is formed with recessed, annular thrust surfaces which have projecting at right angles thereto the oppositely directed ribbon cams. The ribbon cams engage the push rods through cam followers for actuating the same to control the opening of the inlet valves. The throat thickness of the swash plate between the recessed, annular thrust surfaces is of uniform dimension about the circumferential path thereof. Through this arrangement, the swash plate does not tend to bind between opposed, rigidly supported thrust bearings.

It is a further feature of the present invention that the recessed, annular thrust surfaces have their axes coincident with the axis of rotation of the swash plate. Hence, the radial components of the annular thrust surfaces are at right angles to the angle of rotation of the swash plate. By virtue of this arrangement, the arms of the yokes on the confronting ends of the push rods can be of a fixed length and can be of rigid construction.

DESCRIPTION OF THE DRAWINGS

FIG. 1 is a diagrammatic, longitudinal, cross-sectional view of a steam engine embodying the present invention with parts thereof shown in elevation.

FIG. 2 is an enlarged view of a portion of the steam engine shown in FIG. 1.

FIG. 4 is a series of curves showing operating characteristics of the steam engine shown in FIG. 1.

DESCRIPTION OF THE PREFERRED EMBODIMENT

Figure 3:
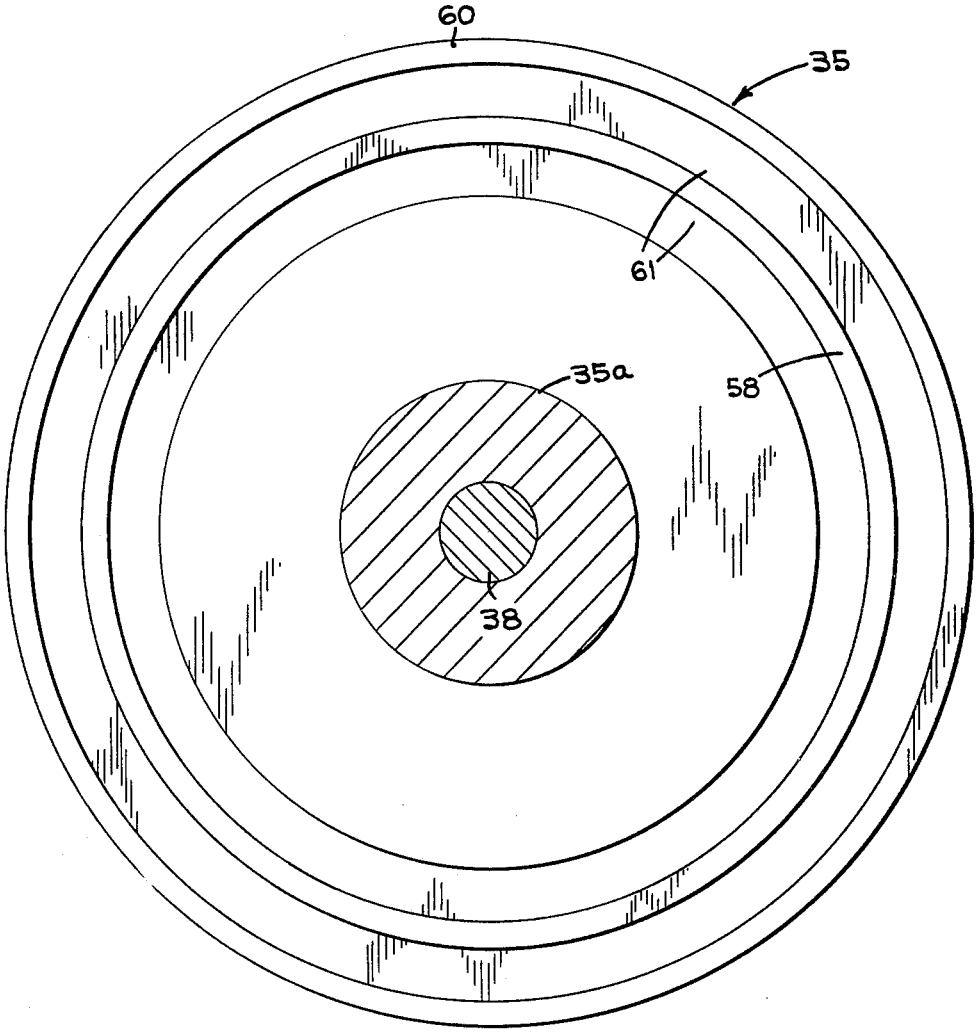
FIG. 3 is an end view of a swash plate employed in the steam engine shown in FIGS. 1 and 2 taken substantially along line 3—3 of FIG. 1.

Illustrated in FIG. 1 is a steam engine 9 embodying the present invention, which is of the type disclosed in the U.S. Pat. No. 3,572,215. The steam engine 9 comprises a central guide structure 20. Fixed to the central guide structure 20 by tie rods 21 in rigid relation are axially aligned cylinders 13 and 14. The cylinders 13 and 14 and the central guide structure 20 are secured to a common foundation, not shown, to form a stationary composite structure.

Disposed within the cylinders 13 and 14, respectively, for reciprocating movement are pistons 10 and 12, which are aligned with one another. The cylinders 13 and 14 are formed, respectively, with inlet ports 16 and 18, and also exhaust ports 13A and 14A, respectively. Steam under pressure is directed into the cylinders 13 and 14 through the inlet ports 16 and 18, respectively. For controlling the flow of steam under pressure into the cylinder 13 through the inlet port 16, an impulse valve, such as ball inlet valve 17, is caged in the cylinder head. In a similar manner, an impulse valve, such as a ball inlet valve 19, is caged in the cylinder head and controls the flow of steam under pressure into the cylinder 14 through the inlet port 18 thereof. A cage 17*a* limits movement of the ball valve 17 to its seat in the port 16 so that when the valve 17 is not supported off its seat by a push rod, steam pressure difference above and below the valve may urge the valve 17 onto its seat in the inlet port 16 of the cylinder 13 to block the flow of steam under pressure into the cylinder 13. Similarly, a cage 18*a* facilitates the seating of the ball valve 19 in the port 18 to block the flow of steam under pressure into the cylinder 14.

The pistons 10 and 12 are formed, respectively, with tubular extensions 10*a* and 12*a*, which are directed toward one another. Integrally formed with the ends of the tubular extensions 10*a* and 12*a* and forming a connection therebetween is a yoke 23. The yoke 23 has four arms 24–27 (FIG. 2).

Centrally disposed between the pistons 10 and 12 are power conversion means 35', which includes a swash plate 35. Formed in the thrust face of the arms 24–27 are hydrodynamic thrust-bearing lubrication pockets 28–31, which by means of a pressure pump and oil passageways, not shown, provide a positive oil film between the thrust faces of the arms 24–27 and the swash plate 35.

The swash plate 35 is formed with a hub 35*a* (FIG. 1) that is journalled for rotation in the fixed central guide structure 20 by bearings 36. A drive shaft 38, which is integrally formed with the hub 35*a*, has a flange 39 on each end thereof for establishing connections with drive members, not shown.

When the steam under pressure alternately enters the cylinders 13 and 14 through the ports 16 and 18, respectively, the pistons 10 and 12 are reciprocated within the cylinders 13 and 14, respectively. As a consequence thereof, the arms 24–27 bear against the thrust faces of the swash plate 35, causing the swash plate 35 to rotate within the bearings 36, thereby imparting a rotary movement to the drive shaft 38. This operation is described in greater detail in the aforementioned U.S. Pat. No. 3,572,215. The swash plate 35 rotates about the axis of the shaft 38. The oppositely directed thrust faces of the swash plate 35 are disposed in parallel planes, which are angularly disposed relative to the axis of rotation of the swash plate 35. Stated otherwise, the thrust faces of the swash plate 35 are not at right angles to the axis of rotation of the swash plate 35.

Valve-actuating means 40 and 50 actuate the ball inlet valves 17 and 19, respectively, in response to the movement of the power conversion means 35' to control the flow of steam under pressure in the cylinder 13 and 14, respectively. Toward this end, the valve-actuating means 40 comprises a push rod 41 that is slidably disposed in the piston extension 10*a*. At the end of the push rod 41 adjacent to the swash plate 35 is secured a yoke 42. A coil spring 43 is disposed between an internal shoulder of the piston extension 10*a* and a washer 44. The washer 44 is fixed to the rod 41 in a transverse relation. A cam follower roller 45 (FIG. 2) is rotatably mounted in the yoke 42.

The valve-actuating means 50 is similar to the valve-actuating means 40. The valve-actuating means 50 includes a push rod 51 that is slidably mounted in the piston extension 12*a* and is oppositely directed relative to the push rod 41. At the end of the push rod 51 adjacent to the swash plate 35 is fixedly secured a yoke 52. A cam follower roller 55 is mounted in the yoke 52. A coil spring 53 is disposed between an internal shoulder of the piston extension 12*a* and a transverse wash 54 fixed to the rod 51.

The spring 43 urges the cam follower roller 45 into continuous engagement with the ribbon cam 57, which projects outwardly from one face of the swash plate 35. Additionally, the ribbon cam 57 extends over a circular path about the axis of rotation of the swash plate 35 at a fixed radius from the axis of rotation of the swash plate 35. Also, the ribbon cam 57 projects away from the swash plate 35 in a direction parallel to the axis of rotation of the swash plate 35. The distance the ribbon cam 57 projects away from the face of the swash plate 35 varies at different points about the axis of the swash plate 35 for reasons to be presently described.

In a like manner, the spring 53 urges the cam follower roller 55 in continuous engagement with the annular ribbon cam 58 that projects away from the opposite face of the swash plate 35. The distance the ribbon cam 58 projects away from the face of the swash plate 58 will vary at different points around the axis of rotation of the swash plate 35. The profile of the ribbon cam 58 is similar to the profile of the ribbon cam 57, except that it is 180 degrees out of phase therewith. Thus, when the ribbon cam 58 has caused the inlet valve 19 to be moved to a fully opened position at the top dead center position of the piston 12, the ribbon cam 57 has allowed the inlet valve 17 to be seated at the bottom dead center position of the piston 10 (FIG. 1). The push rods 41 and 51 move with the pistons 10 and 12, respectively, during part of the piston strokes and move relative to the pistons 10 and 12, respectively, under the control of the swash plate 35, the ribbon cams 57 and 58, respectively, and the cam follower rollers 45 and 55, respectively, to actuate the inlet valves 17 and 19, respectively. Guides, not shown, are provided for the cam follower rollers 45 and 55. Means, not shown, guide the cylindrical crossheads 10*a* and 12*a* so as to prevent rotation of the yoke 23 about the long axis of the reciprocating mass.

Since the piston 10 is in driving contact with the swash plate 35, the relation of the position of the piston 10 in its cylinder 13 is fixed relative to the angular orientation of the swash plate 35. Thus, when the piston 10 is at the top dead center (TDC), its inner thrust arms 24 and 26 contact the thrust face of the swash plate 35 at the leftmost position, when viewed in FIG. 1. Similarly, when the piston 10 is at the bottom dead center (BDC), as illustrated in FIG. 2, the thrust arms 24 and 26 will be in contact with the thrust face at the rightmost position of the swash plate 35. Therefore, if the contour of the ribbon cam 57 is coordinated with the angular orientation of the swash plate 35, the movements of the valve-actuating rod 41, in its actuation of the valve 17, can be coordinated with the position of the piston 10.

Illustrated in FIG. 4 are the curves which illustrate the coordination between the actuation of the inlet valves 17 and 19 and the position of the pistons 10 and 12 that result in the advantageous valve control sequence of the present invention.

Curve A indicates the motion of the reciprocating piston 10 relative to the cylinder head and with respect to time as shown from BDC to TDC and back to BDC. Curve C indicates the motion of the push rod 41 relative to the face of the swash plate 35 and, therefore, the cam profile. It will be noted in FIGS. 1 and 2 that the ribbon cam 57 is displaced a short distance from the face of the swash plate 35 at the initial BDC position. Accordingly, this initial height of the ribbon cam 57 must be taken into consideration when designing the contour of the cam 57 to conform to the profile shown in Curve C.

Curve B indicates the lift of the inlet valve 17 from its seat or the desired motion of the ball inlet valve 17 relative to its cylinder head. The base line "l" indicates the condition wherein the valve 17 is on the seat. The line "o" indicates the full open position of the inlet valve 17 and the distance "d" indicates the total lift of the ball valve 17 (FIG. 1).

It is desirable that the ball inlet valve 17 be opened at low acceleration. In the present invention, this is accomplished by the design of the ribbon cam 57. Comparing Curve C with Curve A, it will be noted that at about 110° of the swash plate 35 rotation and when the piston 10 has moved through about 70% of its stroke toward TDC, the push rod 41 starts to move away from the piston 10 due to ramp R. Just after the rod 41 contacts the inlet valve 17, at approximately 140°, the motion of the rod 41 is slowed down relative to the inlet valve 17 due to declining ramp R'. Thus, the inlet valve 17 is slowly moved off its seat. It should also be noted that the cam contour controls the lead time at which the valve 17 is fully open before the piston 10 reaches TDC. In the illustrated example, the valve 17 is open at about 10° before TDC of the piston 10, as indicated by the reference letter L.

Also, the flow of steam into the cylinder 13 can be cut off at any desired advantageous point. As indicated on Curve A, the distance "x" represents about 10% of the power stroke of the piston 10. On Curve B, the relatively long cutoff time is indicated by the letter L'. The ramp R" controls the closing of the inlet valve 17.

The ribbon cam 58 is, of course, designed similar to cam 57 but its contour is displaced 180° from that of cam 57 so that the piston 12 is being driven through its power stroke while piston 10 is being moved toward TDC, and vice versa.

It is to be observed that the ramp R' involves a retraction motion relative to the piston 10 which subtracts from the advancing piston motion. As a result thereof, there is a net motion of the push rod 41 relative to the valve 17 in which the piston rod 41 is still approaching at a very low velocity. Hence, the ramp R' provides the desired gentle contact and a net slow initial opening of the valve 17. After TDC, with the piston 10 moving away from the cylinder head and ball valve 17, the cam profile lying between R' and R" keeps moving the push rod 41 against piston motion, compensating for the piston motion and thus holding the valve 17 open.

Ramp R" continues to extend the push rod 41 opposite to the piston motion at a rate which no longer fully compensates for the piston motion away from the valve 17. As a consequence thereof, the valve 17 drops rapidly toward its seat with a reduction of the relative velocity at the end of the valve travel. Hence, the valve 17 contacts its seat gently at a low velocity.

The profile to the right of ramp R" (FIG. 4) reverses the motion of the push rod 41 relative to the piston 10, after the valve 17 is closed and the push rod 41 is retracted from the valve 17 in a controlled manner. The push rod 41 is allowed to retract completely into the piston 10. The head of the push rod 41 is shaped to provide a seal against steam leakage along the push rod 41 for discharge from the cylinder 13.

At the right end of the Curve C (FIG. 4), the push rod 41 is in a fully retracted position. This condition also exists at the left end of the Curve C. The push rod 41 is retracted during the ramp R'. Therefore, prior to the initiation of the motion R' (FIG. 4), the push rod 41 is moved away from its seat on the piston head to permit R' to occur. This is a function of ramp R which unseats the push rod 41 from its seat on the piston head so that the aforementioned retraction caused by R' takes place.

The above angles and percentages are intended to be preferred embodiments. It is understood that the angles of 110° could be greater or smaller without affecting the value of lead or cutoff. Similarly, the lead L, which is indicated as about 10° before TDC, could be greater or smaller than shown. The cutoff L', which is indicated as about 10% of the stroke, could be greater or lesser in a given application.

From the foregoing description, it will be evident that the present invention provides a valve control system for a swash plate steam engine wherein the inlet valve can be opened on as short a lead before TDC as desired, and with low acceleration. Further, the ribbon cam can cause closing of the valve at any desired point after TDC. Thus, a valve event can be provided that is desirably asymmetrical with respect to the TDC of the piston, that is, a short lead and a long cutoff as indicated by L and L' on Curve B.

The swash plate 35 is formed with an annular rim 60. Radially inward from the rim 60, the swash plate 35 is formed with oppositely directed, recessed, annular thrust surfaces 61 and 62. Projecting from the recessed, annular thrust surfaces 61 and 62 at right angles thereto are the oppositely directed ribbon cams 58 and 57, respectively. The throat thickness "t" of the swash plate 35 between the circumferential paths of the recessed, annular thrust surfaces 61 and 62 is of a uniform dimension along said circumferential paths. The thrust bearings, as defined by the hydrodynamic thrust-bearing lubrication pockets 28–31 are sufficiently separated to permit the ribbon cams 57 and 58 to move freely therebetween. With the throat thickness "t" of uniform dimension along the circumferential paths of the thrust surfaces 61 and 62, the swash plate 35 does not tend to bind between the opposed, rigidly supported thrust bearings.

The thrust bearings, in the preferred embodiment, would be flat in a radial direction and would be slightly of convex curvature in a circumferential direction. The convex curvature of the thrust shoe would be slightly greater than is required to clear any moderate localized concavity of the thrust face. The additional curvature would serve to allow the thrust shoe to ride only the oil film on the advancing thrust face of the swash plate 35 to promote improved lubrication between the bearing surfaces.

The axes of the recessed, annular thrust surfaces 61 and 62 are coincident with the axis of rotation of the shaft 38. Therefore, the radial components of the thrust surfaces 61 and 62 are at right angles to the axis of rotation of the swash plate 35. The throat thickness "t" between thrust surfaces 61 and 62 is of uniform dimension around the full perimeter of the thrust surfaces. This arrangement enables the arms 24–27 of the yoke 23 to be of a predetermined length and to be rigid.

I claim:

1. A steam engine comprising:

(a) a source of steam under pressure;

(b) a first cylinder forming a first chamber and formed with an inlet port communicating with said first chamber and an exhaust port communicating with said first chamber;

(c) a first inlet valve communicating with said source of steam and said first chamber through said inlet port for controlling the flow of steam in said first chamber;

(d) a first piston disposed within said first chamber of said first cylinder, said first piston being reciprocated within said first chamber of said first cylinder by the flow of steam in said first chamber;

(e) power conversion means operatively responsive to the reciprocating movement of said first piston for converting the rectilinear movement of said first piston to a rotary motion, said power conversion means comprising a swash plate rotated about an axis by the reciprocating movement of said first piston, said swash plate being formed with a first annular thrust surface on one face thereof, said one face of said swash plate being disposed in a plane which is angularly disposed relative to the axis of rotation of said swash plate, said first annular thrust surface having an axis coincident with the axis of rotation of said swash plate and the radial components of said first thrust surface being at right angles to the axis of rotation of said swash plate; and (f) first valve-actuating means operatively responsive to the movement of said power conversion means and arranged to engage said first inlet valve for controlling the opening and closing of said first inlet valve, (g) said swash plate having a first cam mounted on said one face thereof and projecting from said first thrust surface, said first actuating means being arranged to engage said first cam to be actuated thereby for controlling the opening and closing of said first inlet valve, (h) said first valve-actuating means comprising a first push rod slidably journalled for movement parallel to the path of travel of said first piston, said first push rod at one end portion thereof having a first cam follower for engaging said first cam and at another end portion thereof said push rod being adapted to engage said first inlet valve for controlling the opening and closing of said first inlet valve in response to the rotation of said swash plate, (i) said first piston being formed with a first tubular extension extending toward said swash plate and said first push rod being disposed in said first tubular extension of said first piston, whereby said first push rod moves with said first piston during a portion of its reciprocating movement and said first push rod moves relative to said first piston under the urgency of said first cam of said swash plate to actuate said first inlet valve.

2. A steam engine as claimed in claim 1 wherein said first thrust surface is recessed in said swash plate.

3. A steam engine as claimed in claim 1 wherein said first cam is contoured to effect the opening of said first inlet valve on a short lead before said first piston reaches its top dead center position and enables said first inlet valve to cut off the flow of steam into said first cylinder at a relatively long interval after said first piston has reached its top dead center.

4. A steam engine as claimed in claim 3 wherein said first inlet valve is in the form of a ball inlet valve disposed in the head of said first cylinder and adapted to be moved between a position seated over and a position displaced from said inlet port of said first cylinder.

5. A steam engine as claimed in claim 3 wherein the contour of said first cam enables said first inlet valve to be opened and closed with a low acceleration relative to its fixed seat.

6. A steam engine as claimed in claim 5 wherein said first cam is a ribbon cam.

7. A steam engine comprising:

(a) a source of steam under pressure;

(b) a first cylinder forming a first chamber and formed with an inlet port communicating with said first chamber and an exhaust port communicating with said first chamber;

(c) a first inlet valve communicating with said source of steam and said first chamber through said inlet port for controlling the flow of steam in said first chamber;

(d) a first piston disposed within said first chamber of said first cylinder, said first piston being reciprocated within said first chamber of said first cylinder by the flow of steam in said first chamber;

(e) power conversion means operatively responsive to the reciprocating movement of said first piston for converting the rectilinear movement of said first piston to a rotary motion;

(f) first valve-actuating means operatively responsive to the movement of said power conversion means and arranged to engage said first inlet valve for controlling the opening and closing of said first inlet valve;

(g) a second cylinder forming a second chamber and formed with an inlet port communicating with said second chamber and an exhaust port communicating with said second chamber, said second cylinder being axially aligned with said first cylinder;

(h) a second inlet valve communicating with said source of steam and said second chamber through said inlet port of said second cylinder for controlling the flow of steam in said second chamber;

(i) a second piston disposed within said second chamber of said second cylinder, said second piston being reciprocated within said second chamber of said second cylinder by the flow of steam in said second chamber, said second piston being aligned with said first piston, (j) said power conversion means being operatively responsive to the reciprocating movement of said second piston for converting the rectilinear movement of said second piston to a rotary motion; and (k) second valve-actuating means operatively responsive to the movement of said power conversion means and arranged to engage said second inlet valve for controlling the opening and closing of said second inlet valve, (l) said power conversion means comprising a swash plate rotated about an axis by the reciprocating movement of said first and second pistons, said swash plate being disposed between said first and second pistons, (m) said swash plate being formed with oppositely directed first and second annular thrust surfaces in oppositely directed faces thereof, said oppositely directed faces of said swash plate being disposed in parallel planes, which are angularly disposed relative to the axis of rotation of said swash plate, said first and second annular thrust surfaces having their respective axes coincident with the axis of rotation of said swash plate and the radial components of said first and second annular thrust surfaces being at right angles to the axis of rotation of said swash plate, (n) said swash plate having a first cam mounted on one of said faces thereof and projecting from said first thrust surface, said swash plate having a second cam mounted on the other of said faces thereof and projecting from said second thrust surface, said first valve-actuating means being arranged to engage said first cam to be actuated thereby for controlling the opening and closing of said first inlet valve, said second valve-actuating means being arranged to engage said second cam to be actuated thereby for controlling the opening and closing of said second inlet valve, (o) said first valve-actuating means comprising a first push rod slidably journalled for movement parallel to the path of travel of said first piston, said first push rod at one end thereof having a first cam follower for engaging said first cam and at another end thereof said first push rod being adapted to engage said first inlet valve for controlling the opening and closing of said first inlet valve in response to the rotation of said swash plate, said second valve-actuating means comprising a second push rod slidably journalled for movement parallel to the path of travel of said second piston, said second push rod at one end thereof having a second cam follower for engaging said second cam and at another end portion thereof said second push rod being adapted to engage said second inlet valve in response to the rotation of said swash plate, said first and second push rods being oppositely directed with one end portion thereof confronting said swash plate, (p) said first piston being formed with a first tubular extension extending toward said swash plate and said first push rod being disposed in said first tubular extension of said first piston, whereby said first push rod moves with said first piston during a portion of its reciprocating movement and said first push rod moves relative to said piston under the urgency of said first cam of said swash plate to actuate said first inlet valve, said second piston being formed with a second tubular extension extending toward said swash plate and said second push rod being disposed in said said second extension of said second piston, whereby said second push rod moves with said second piston during a portion of its reciprocating movement and said second push rod moves relative to said second piston under the urgency of said second cam of said second inlet valve.

8. A steam engine as claimed in claim 7 wherein said first and second annular thrust surfaces of said swash plate are recessed in said oppositely directed faces of said swash plate respectively, the thickness of said swash plate between said first and second annular thrust surfaces being constant along the circumferential paths thereof.

9. A steam engine as claimed in claim 8 wherein said first cam is contoured to effect the opening of said first inlet valve on a short lead before said first piston reaches its top dead center position and enables said first inlet valve to cut off the flow of steam into said first cylinder at a relatively long interval after said first piston has reached its top dead center; and wherein said second cam is contoured to effect the opening of said second inlet valve on a short lead before said second piston reaches its top dead center position and enables said second inlet valve to cut off the flow of steam into said second cylinder at a relatively long interval after said second piston has reached its top dead center, said first and second cams being displaced by 180 degrees.

10. A steam engine as claimed in claim 9 wherein said first inlet valve is in the form of a ball inlet valve disposed in the head of said first cylinder and adapted to be moved between a position seated over and a position displaced from said inlet port of said first cylinder; and wherein said second inlet valve is in the form of a ball inlet valve disposed in the head of said second cylinder and adapted to be moved between a position seated over and a position displaced from said inlet port of said second cylinder.

11. A steam engine as claimed in claim 10 wherein the contour of said first cam enables said first inlet valve to be opened and closed with a low acceleration relative to its fixed seat, and wherein the contour of said second cam enables said second inlet valve to be opened and closed with a low acceleration relative to its fixed seat.

12. A steam engine as claimed in claim 11 wherein said first cam is in the form of a ribbon cam and wherein said second cam is in the form of a ribbon cam.

* * * * *